US005874714A

United States Patent [19]

Sik

[11] Patent Number: 5,874,714

[45] Date of Patent: Feb. 23, 1999

[54] MICROWAVE OVEN WITH POWER CORD ISOLATED FROM HOT COMPONENTS

[75] Inventor: Lim Gyu Sik, Suwon, Rep. of Korea

[73] Assignee: Samsung Electronics Co., Ltd., Suwon, Rep. of Korea

[21] Appl. No.: 721,542

[22] Filed: Sep. 26, 1996

[30] Foreign Application Priority Data

Oct. 9, 1995 [KR] Rep. of Korea ..... 1995-28178

[51] Int. Cl.[6] ..... H05B 6/64; F24C 15/36

[52] U.S. Cl. ..... 219/68.1; 219/685; 219/756; 219/400; 126/21 A

[58] Field of Search ..... 219/681, 685, 219/756, 757, 400; 126/21 R, 21 A

[56] References Cited

U.S. PATENT DOCUMENTS

| | | | |
|---|---|---|---|
| 4,481,396 | 11/1984 | Matsubayashi et al. | 219/681 |
| 4,591,683 | 5/1986 | Eke | 219/681 |
| 4,635,615 | 1/1987 | Itoh et al. | 126/21 A |
| 4,940,869 | 7/1990 | Scholtes et al. | 219/681 |
| 5,112,630 | 5/1992 | Scott | 219/388 |

*Primary Examiner*—Philip H. Leung
*Attorney, Agent, or Firm*—Burns, Doane, Swecker & Mathis, L.L.P.

[57] ABSTRACT

A microwave oven includes a housing forming a cooking chamber and a compartment next to the cooking chamber for containing various electrical components. A power supply cord extends from the compartment through a cord hole in a back side of the housing to supply power to the electrical components. A heater, fan and fan motor are disposed adjacent a rear portion of the cooking chamber for performing a convection cooking operation, whereby a hot zone on the rear side of the housing located directly behind the cooking chamber may be heated to a temperature capable of damaging the cord if coming into contact therewith. An element is screwed to the back side of the housing below the cord hole to contact a portion of the cord located exteriorly of the housing to physically isolate the cord from the hot zone.

7 Claims, 6 Drawing Sheets

MICROWAVE OVEN WITH POWER CORD ISOLATED FROM HOT COMPONENTS

BACKGROUND OF THE INVENTION

The present invention relates to a microwave oven, and more particularly, a device for preventing heat damage to an electric power cord for a microwave oven having a convectional cooking function.

Generally, the microwave oven is a cooking appliance which cooks foods by frictional heat generated by causing molecules of the foods to move at high speeds utilizing high frequency energy. Recently, there has been developed a convectional microwave oven having a cooking function characterized by a forced convection of hot air created by an electric heater and a blower fan in addition to the basic cooking function by high frequency energy. In such a conventional microwave oven, the cooking of foods such as meat and fish are boiled evenly from surface to interior by high frequency energy and at the same time, the surface of the foods is browned crispy by the heating of the hot air, so that the taste and flavor of foods are enhanced.

FIG. 5 illustrates a prior art convection microwave oven disclosed in Japanese Utility Model Publication No. 57-132118. As shown in FIG. 5, the prior art convection microwave oven has an inner case la forming a cooking chamber 1 and an outer case 6 surrounding the inner case 1*a,* wherein an electric component compartment(not shown) for mounting various electric components is located between the inner and outer cases 1*a* and 6. In the back of the cooking chamber 1, a duct 7*a* is provided between a rear plate 4*a* connected to the rear portion of the inner case 1*a* and the outer case 6 to form a hot air chamber 7 in which a blower fan 8 and an electric heater(not shown) are provided.

In an inner wall of the duct 7*a,* an insulating material 7*b* is fixed to prevent heat radiated from the heater from transferring backward. In the rear of the duct 7*a,* a cooling fan 8*a,* coaxially arranged with the blower fan 8, and a motor 8*b* for driving the cooling fan 8*a* and the blower fan 8 are provided. The duct 7*a,* the cooling fan 8*a* and the motor 8*b* are covered by a rear plate 6*a* connected to the rear portion of the outer case 6. The rear plate 6*a* has a plurality of air vents 9*a* and 9*b* for ventilating air by the operation of the cooling fan 8*a.*

In such a prior art convection microwave oven, high-temperature heat radiated from the heater and motor 8*b* are transferred to the rear of the microwave oven by the cooling fan 8*a* provided in the rear of the cooking chamber 1.

Therefore, in a convection cooking mode in which the electric heater is operated, the hot air chamber 7 located in the rear of the cooking chamber 1 and the rear plate 6*a* are relatively maintained at a high temperature. Further, as shown in FIG. 6, in the rear portion of the microwave oven, a power cord 2 for supplying the power to the microwave oven is provided. One end of the power cord 2 is fixed to the interior of the electric component compartment, and the other end having a plug 3 extends from the outer case 6 to the exterior and is inserted into a receptacle (not shown).

In such a microwave oven, however, the power cord 2 makes contact with highly heated elements and is apt to be damaged. That is, since the high-temperature heat emitted from the motor 8*b* and the heater located in the rear of the cooking chamber 1 is transferred to the rear plate 6*a* of the outer case 6, the power cord 2, which is movable freely, may touch the rear plate 6*a* and become damaged by its very high temperature. If such a contact often occurs, the life cycle of the power cord 2 is shortened and is apt to cause a short-circuit.

SUMMARY OF THE INVENTION

Therefore, it is an object of the present invention to provide a device capable of preventing heat damage to an electric power cord in the microwave oven by isolating the power cord from contact with high-temperature parts.

In order to achieve this object, this invention provides a convection microwave oven comprising a cooking chamber of which an electric heater and a motor are arranged in its rear portion, an electric component compartment in which various electric components are installed, and a power cord extending from the electric component compartment to the exterior, and means for preventing damage to the power cord by heat radiated from the electric heater and the motor.

The means for preventing the damage to the power cord by heat comprises a cord clamp installed on an extending plate of an inner case arranged in the rear portion of the electric component compartment for positioning the power cord out of contact with a rear plate of the inner case and a protective cover coupled to the rear plate. A locking screw fixes the cord clamp to the extending plate of the inner case. The cord clamp has a ring shape, its inner diameter being a little larger than the outer diameter of the power cord.

Therefore, since the electric power cord extending from the upper portion of the rear of the electric component compartment is fixed to the cord clamp fixedly located in the lower portion of the rear of the electric component compartment, heat damage to the power cord caused by contact of the cord with the rear portion of the cooking chamber can be prevented.

Other features and objects of the present invention will be apparent from the following description in connection with the accompanying drawings.

DETAILED DESCRIPTION OF THE PREFERRED EMBODIMENT

Figure 1:
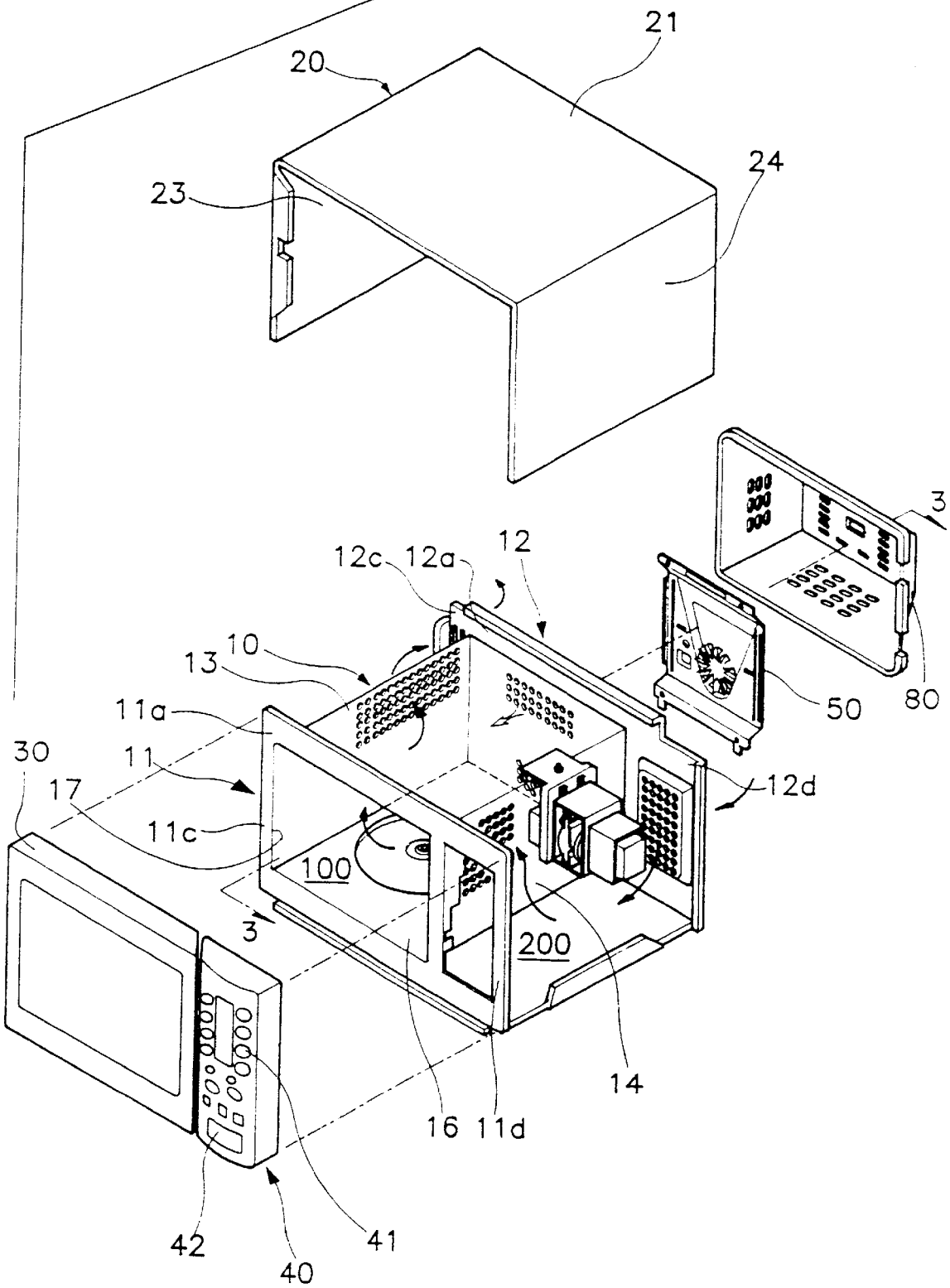
FIG. 1 is an exploded perspective view of a convection microwave oven to which the present invention is applied.

As shown in FIG. 1, a convection microwave oven to which the present invention is applied is comprised of an inner case 10, an outer case 20 which forms a housing assembly together with the inner case 10, and various kinds of electric components mounted between the inner and outer cases 10 and 20. A duct 50 and a protective cover 80 are coupled to the rear of the inner case 10 in a way to be spaced from each other.

The inner case 10 is comprised of a front plate 11, a rear plate 12, a left side plate 13, a right side plate 14, and a bottom plate 16, which form a cooking chamber 100. In the front plate 11, an opening 17 which functions as the inlet of the cooking chamber 100 is formed. The front plate 11 includes an upper extending plate portion 11*a,* a left extending plate portion 11*c,* and a right extending plate portion 11*d,* each being extended to predetermined widths. The rear plate 12 facing the front plate 11 also includes an upper extending plate portion 12*a,* a left extending plate 12*c,* and a right extending plate portion 12*d,* each being extended to predetermined widths.

The outer case 20 includes a top plate 21, a left side plate 23, and a right side plate 24. Edges of each plate forming the outer case 20 are coupled to edges of the extending plate portions of the front and rear plates 11 and 12 of the inner case 10 to form the main body of the microwave oven.

Here, lengths from the front to the rear of each plate forming the outer case 20 are equal to those of each front-to-rear extending plate of the inner case 10.

To the front plate 11 of the inner case 10, a door 30 is coupled to open and close the cooking chamber 100, and mounted to the right extending plate portion 11*d* of the front plate 11, is a control box 40 having a display 41 and buttons 42 arranged therein.

Figure 2:
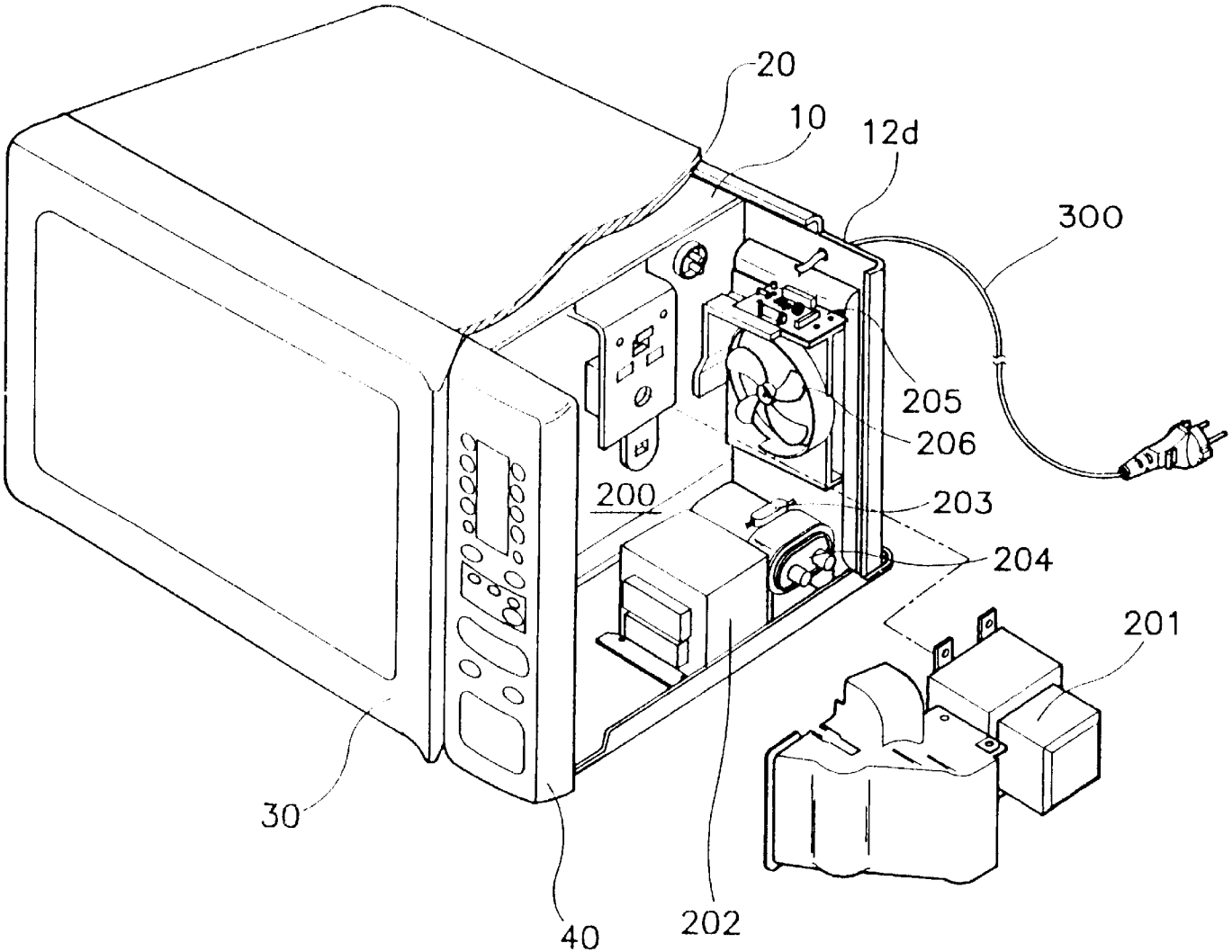
FIG. 2 is a rear perspective view of this invention, partly broken away for showing an electric component compartment.

As shown in FIG. 2, in an electric component compartment 200, a magnetron 201 of a high frequency generating means is installed. Also, a high voltage transformer 202 for applying a high voltage to the magnetron 201, a high voltage diode 203, a high voltage capacitor 204, and a printed circuit board 205 functioning as a control means are installed in the periphery of the magnetron 201. A cooling fan 206, for cooling the electric components which generate high temperature on operation, is mounted on the right extending plate portion 12*d* of the rear plate 12.

Figure 3:
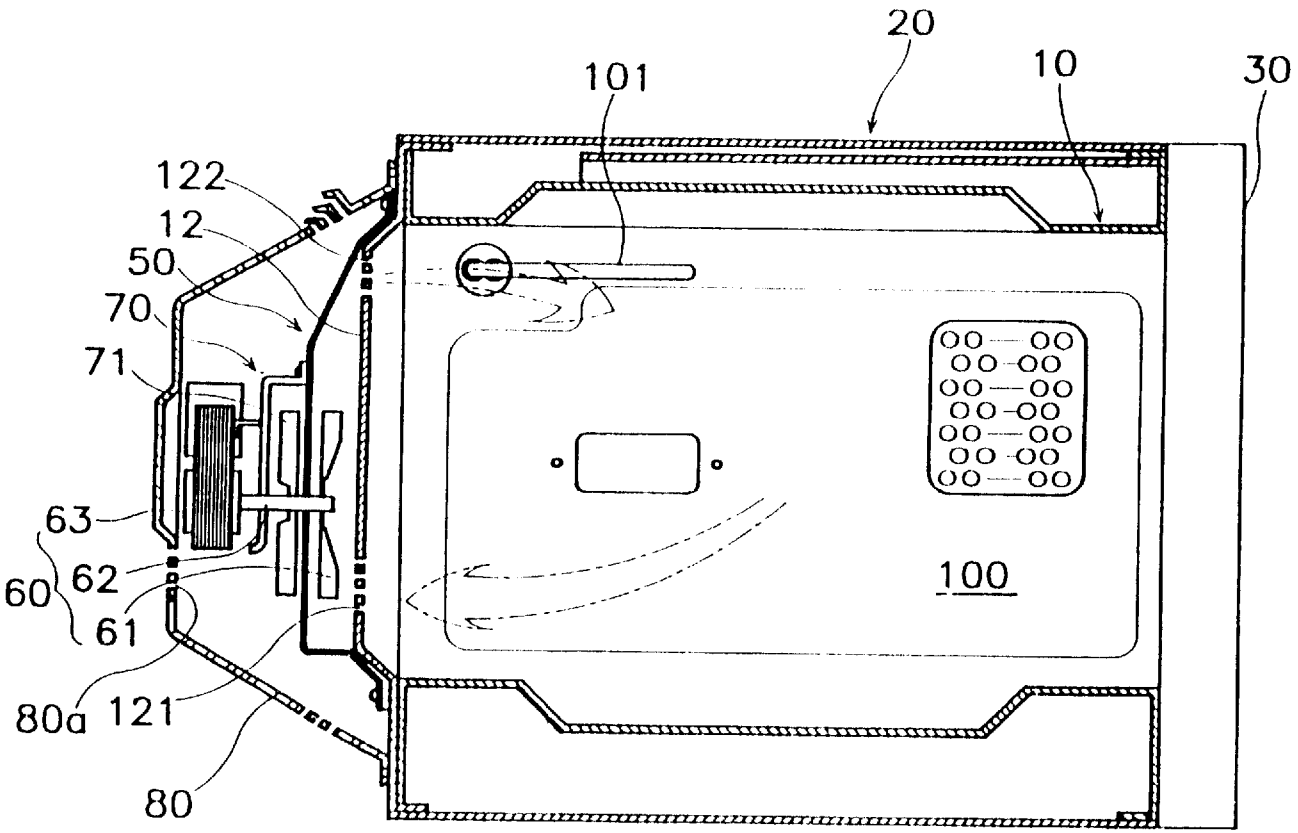
FIG. 3 is a cross-sectional view taken along a line 3—3 in FIG. 1.

As shown in FIG. 3, an electric heater 101 functioning as a heating means is installed inside of the cooking chamber 100. The electric heater 101 is pivotally mounted on the upper portion of the cooking chamber 100. A plurality of intake and exhaust holes 121 and 122 for guiding forced convection of hot air are formed in the rear plate 12 of the inner case 10, and to the outside of the rear plate 12, the duct 50 is coupled. Thus, the intake and exhaust holes 121 and 122 serve to communicate the cooking chamber 100 with the interior of the duct 50.

To the duct 50, a convecting means 60 and a cooling means 70 are installed. The convecting means 60 includes a blower fan 61 installed inside of the duct 50, a rotating shaft 62 installed through the duct 50 having its one end coupled to the blower fan 61, and a motor 63 installed at the other end of the rotation shaft 62. The cooling means 70 includes a cooling fan 71 coupled to the shaft 62 between the duct 50 and the motor 63.

To protect the duct 50, the cooling fan 71, and the motor 63, the protective cover 80 having a size to fully cover them is coupled to the back side plate 12 of the inner case 10. The protective cover 80 has a plurality of air vents 80*a* for venting outside air by the operation of the cooling fan 71.

Figure 4:
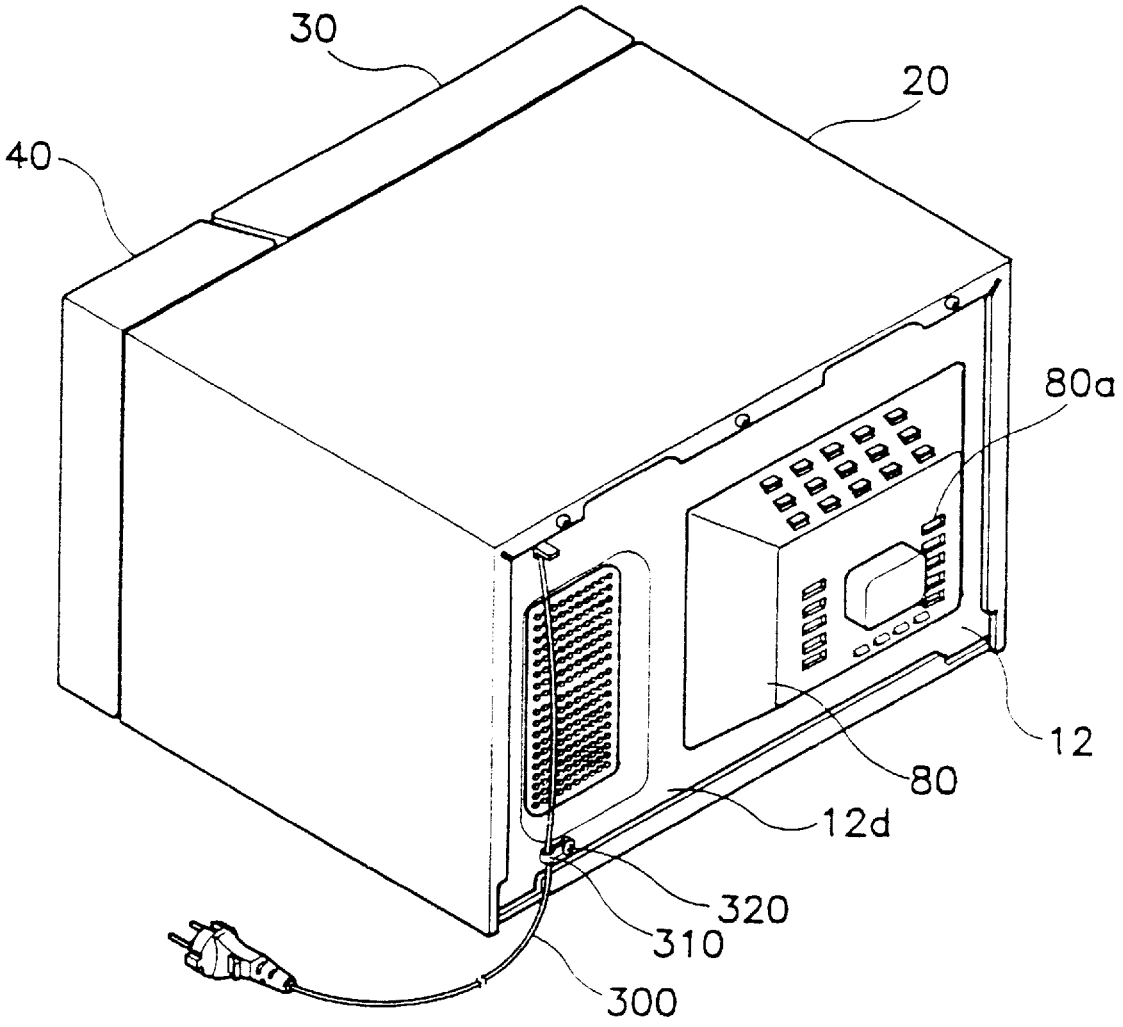
FIG. 4 is a rear perspective view of the convection microwave oven showing the device for preventing heat damage of an electric power cord according to this invention.
Figure 5:
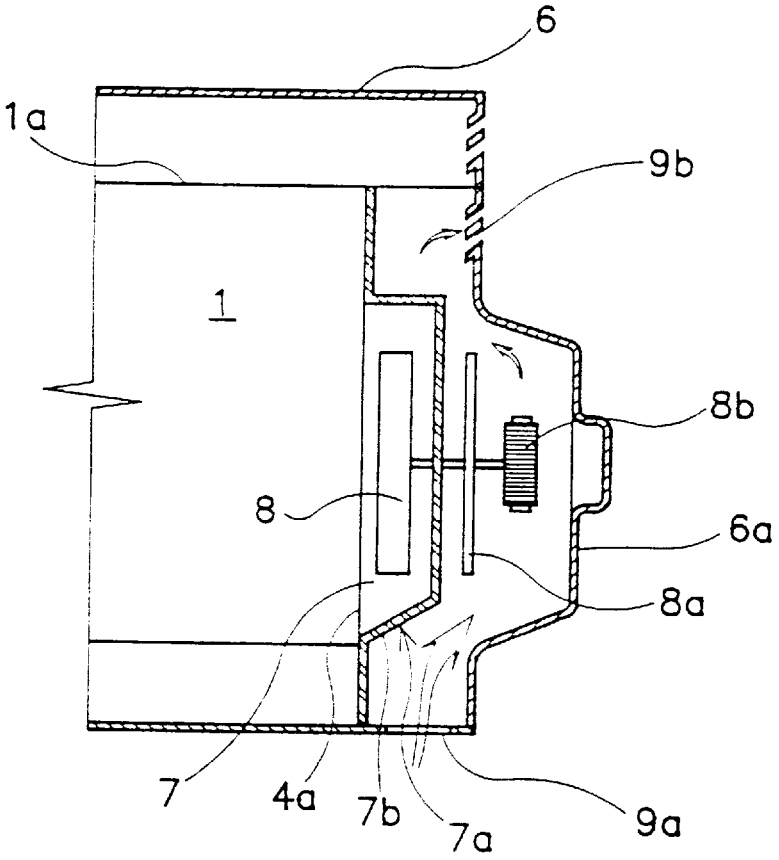
FIG.5 (PRIOR ART)
FIG. 5 is a side cross-sectional view showing a schematic construction of a prior art convection microwave oven.
Figure 6:
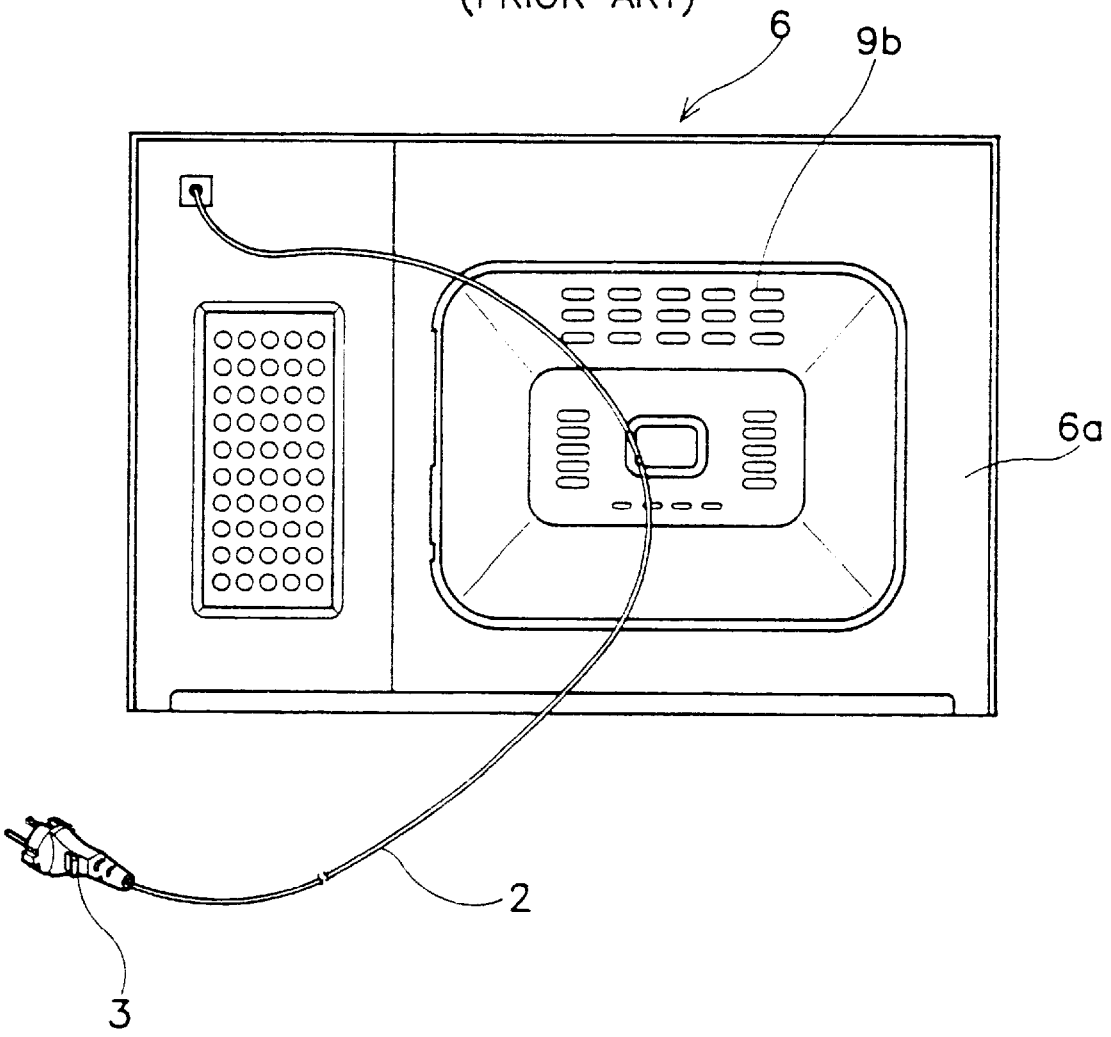
FIG. 6 (PRIOR ART)
FIG. 6 is a rear elevational view of FIG. 5.

Referring to FIG. 4, a device for preventing heat damage to electric power cord according to the present invention will now be described.

There is a power cord 300 one end of which extends into the upper portion of the electric component compartment 200(refer to FIG. 2) through the extending plate portion 12*d* of the inner case 10.

Further, to the lower portion of the external side of the extending plate portion 12*d* of the inner case 10 is provided a cord clamp 310 to which the power cord 300 can be inserted and fixed. The cord clamp 310 has a ring shape which is a little larger than the outer diameter of the power cord 300, and is coupled by a screw 320 to the extending plate portion 12*d* of the inner case 10. Thus, by inserting the power cord 300 into the clamp 310 and screwing the locking screw 320 to the clamp 310 and the extending plate 12*d,* the power cord 300 is assembled easily. Since the electric power cord extending from the upper portion of the electric component compartment is fixedly positioned by the cord clamp 310, it is not possible for the power cord 300 to come in contact with the protective cover 80 or the portion of the rear plate 12 located directly behind the cooking chamber 100.

That is, during cooking utilizing forced convection of hot air, the rear plate 12 of the inner case 10 and the protective cover 80 maintain a high temperature by heat generated by the operation of the electric heater 101 and the motor 63. However, since the power cord 300 is held by the clamp 310, in laterally spaced relationship to the cover 80 and the heating chamber, the cord can not make contact with high temperature components. Therefore, heat damage to the power cord 300 can be prevented according to the present invention.

What is claimed is:

1. A microwave oven, comprising:

a housing forming a cooking chamber;

an electric component compartment located in the housing next to the cooking chamber and containing a plurality of electrical components, including a microwave generator for supplying microwaves to the cooking chamber;

a power cord extending into the electric component compartment through a hole disposed in a rear side of the housing located behind the electrical components compartment for supplying electric power to the electrical components, whereby an external portion of the cord is situated outside of the housing;

an electric heater, a fan, and a fan motor disposed adjacent a rear portion of the cooking chamber for performing a convection heating operation, such that heat generated during operation of the heater and fan motor highly heats a portion of the rear side of the housing to a temperature capable of damaging the cord if able to contact the cord; and isolating means for isolating the external portion of the cord from the highly heated portion of the rear side of the housing to prevent contact therewith, the isolating means comprising an element fixed to the housing and contacting the external portion of the cord for restraining movement of the external portion of the cord into contact with the highly heated portion of the rear side of the housing.

2. The microwave oven according to claim 1 wherein the element is spaced below the hole.

3. The microwave oven according to claim 2 wherein the element is spaced directly vertically beneath the hole.

4. The microwave oven according to claim 2 wherein the hole is located adjacent an upper edge of the rear side, and the element is located adjacent a lower edge of the rear side.

5. The microwave oven according to claim 1 wherein the element includes a portion extending around at least a portion of a circumference of the cord.

6. The microwave oven according to claim 5 wherein the element is fixed to the back side of the housing by a screw.

7. The microwave oven according to claim 1 wherein the element includes a ring-shaped portion through which the cord extends, and a mounting portion fixed to the back side of the housing.

* * * * *